US005419291A

United States Patent [19]

Kimata et al.

[11] Patent Number: 5,419,291

[45] Date of Patent: May 30, 1995

[54] ELECTRONIC FUEL INJECTION SYSTEM WITHOUT BATTERY FOR INTERNAL COMBUSTION ENGINE

[75] Inventors: Ryuichi Kimata; Katsuyuki Morichika; Ryuhei Tamamoto, all of Saitama, Japan

[73] Assignee: Honda Giken Kogyo Kabushiki Kaisha, Tokyo, Japan

[21] Appl. No.: 72,939

[22] Filed: Jun. 8, 1993

[30] Foreign Application Priority Data

Jun. 16, 1992 [JP] Japan ..... 4-180503
Jun. 30, 1992 [JP] Japan ..... 4-194508

[51] Int. Cl.[6] ..... F02N 3/02; F02M 51/00; F02P 1/02

[52] U.S. Cl. ..... 123/179.16; 123/491; 123/185.3

[58] Field of Search ..... 123/179.16, 179.17, 123/179.24, 179.28, 491, 480, 185.3, 508, 509, 491

[56] References Cited

U.S. PATENT DOCUMENTS 5,009,211 4/1991 Kushida et al. ..... 123/491
5,027,779 7/1991 Nishiyama ..... 123/491
5,133,311 7/1992 Hallgren ..... 123/179.16
5,161,496 11/1992 Matsushima et al. ..... 123/185.3
5,205,255 4/1993 Yamagata et al. ..... 123/491

*Primary Examiner*—Henry C. Yuen
*Assistant Examiner*—Thomas N. Moulis
*Attorney, Agent, or Firm*—Pollock, VandeSande and Priddy

[57] ABSTRACT

Electric power is generated with rotation of a flywheel and crankshaft rotated by a starting operation of a recoil starter and supplied for driving and controlling a fuel injection valve, the fuel injection valve is supplied with fuel pressurized by a mechanical pump driven in an interlocked relation to the crankshaft, and control means provides an "open" instruction to the fuel injection valve driving means in response to at least one of a voltage appearing on a reset input terminal of a microcomputer for controlling the fuel injection valve during resetting of the microcomputer. After completion of the resetting of the microcomputer, the fuel injection valve is controlled so as to cause fuel injection during "open" valve intervals based on a predetermined fuel injection pattern at predetermined fuel injection timings.

15 Claims, 5 Drawing Sheets

ELECTRONIC FUEL INJECTION SYSTEM WITHOUT BATTERY FOR INTERNAL COMBUSTION ENGINE

BACKGROUND OF THE INVENTION

1. Field of the Invention

This invention relates to an electronic fuel injection system, without a battery, for an internal combustion engine and, more particularly, to an electronic fuel injection system without any battery for a small displacement engine.

2. Description of the Prior Art

An electronic fuel injection controller has been known, which controller is provided with a fuel injection valve in an intake-manifold of an engine for controlling the amount of injected fuel by controlling the open period of the injection valve in accordance with the engine operation conditions.

Recently, consideration has been given to application of electronic fuel injection systems to small displacement internal combustion engines such as universal engines and agricultural engines, which do not use a power source battery but are manually started with rope starters, i.e., recoil starter systems.

The electronic fuel injection system that does not use any battery operates stably with sufficient power supplied from a generator equipped on the engine to an electronic control unit (ECU) including a microcomputer. However, at the time of the start by the recoil starter noted above, sufficient power is not supplied to the ECU, and therefore it is unable to operate a fuel injection valve.

The relationship between various parameters and control signal timing at the time of the start will now be described with reference to FIG. 6. Immediately after the commencement of cranking by the starting operation of the recoil starter, the engine rpm Ne is quickly increased. Also, the generator output voltage $V_{ACG}$ induced with flywheel rotation is quickly increased to reach a substantially stable voltage range with surpassing of a predetermined value by the inertial rpm of the flywheel. When the start is succeeded, the engine rpm Ne is further increased as shown by solid curve "a" to enter self-sustained operation, while the generator output voltage $V_{ACG}$ is held substantially at a constant value as shown by solid curve "c". When the start has failed, the engine rpm Ne and generator output voltage $V_{ACG}$ are quickly reduced as shown by dashed curves "b" and "d".

When a TDC pulse P1 indicative of the top dead center is detected at an instant t6, the ECU outputs an injection valve start signal. In response to this signal, a predetermined terminal voltage is applied to a fuel injection valve drive coil to cause current through the valve drive coil, thus opening the valve to inject fuel into an intake manifold. As a result, at an ignition timing (when a pulse P2 is generated) immediately after the fuel injection, the fuel is ignited to enter self-sustaining operation.

At an instant t1 of reaching of the lowest operation voltage $V_E$ of the ECU by the generator output voltage, the ECU which is of low-active type or negative logic type turns to be reset. Up to an instant t4 of completion of the resetting, however, normal operation cannot be obtained, and therefore the TDC pulse P1 generated at an earlier instant t3 can not be detected. At a subsequent TDC pulse generation instant t6, at which the ECU is operating normally after the completion of the resetting, the TDC pulse P1 is detected, and in response to this detection the injection valve start signal is turned on. At an instant t2, the lowest fuel injection valve operation voltage $V_J$ is reached by the output voltage.

As shown, since no fuel can be injected in response to the TDC pulse P1 before the ignition timing at the instant t5, the chance of ignition in one starting operation of the recoil starter takes place only once at the instant t6 under the condition of the generator output voltage shown in FIG. 6. Therefore, there is a problem that the possibility of the success of the start is reduced.

Japanese Patent Laid-Open No. 63-170528 proposes a fuel injection apparatus comprising a start, fuel feeder to be used only at the time of the start and engine start operation detection means operable with a negative pressure in the intake manifold when the engine is manually started. In this fuel injection apparatus, upon detection of the engine start operation by the engine start operation detection means fuel is supplied to the start fuel feeder and injected into the intake manifold. In this fuel injection apparatus, the start fuel injector is not opened by using any power-operated actuator. Instead, a valve provided upstream of the start fuel injector is opened by mechanical force based on the intake manifold negative pressure to supply fuel to the start fuel injector from a fuel tank. The fuel tank is provided at a higher level than the start fuel injector, and fuel is supplied by head pressure.

Japanese Patent Laid-Open No. 68-259129 discloses a fuel injection apparatus in which, until the setting-in of the self-sustaining operation of the engine, the fuel injection valve is opened to inject start fuel not by microcomputer control but by supplying operating power to the fuel injection valve via a separate route.

In the former disclosed fuel injection apparatus, it is necessary to provide the start fuel injector, a duct for negative pressure detection and a negative pressure operating valve only for the fuel injection at the time of the start. The addition of these components to a small displacement engine adopting the recoil starter system, is undesirable in that it not only complicates the fuel supply system but also increases the size and cost of the engine. Further, with the fuel supply based on the head pressure, the fuel supply pressure is not stabilized. In order to be able to steadily maintain sufficient fuel supply pressure (fuel pressure), a pump capable of supplying pressurized fuel is desirably provided. However, at the time of the engine start with the recoil starter, it is difficult to ensure sufficient fuel pressure right after the start operation even by using such a pump. Therefore, there remains the problem that a sufficient amount of fuel cannot be injected at the time of starting.

In the latter disclosed fuel injection apparatus, fuel is injected without any microcomputer control for a period from the instant of reaching of the lowest fuel injection valve operation voltage until the completion of the engine start. Therefore, there is a trend for excessive fuel supply, resulting in the discharge of exhaust gas containing a fair amount of unburned fuel-air mixture at the time of the start. In addition, when the starting operations are repeated due to a failure of starting, a great amount of non-combusted gas is retained in the cylinder, thus progressively increasing the difficulty of starting the engine.

SUMMARY OF THE INVENTION

An object of the present invention is to provide an electronic fuel injection system without a battery for a small displacement internal combustion engine, which permits an adequate amount of fuel for injection to be ensured at the time of starting the engine without complicating the construction and increasing the size of the engine.

A feature of an embodiment of the present invention resides in the provision of power source means for supplying, for driving and controlling a fuel injection valve, an electric power generated by rotation of a flywheel coupled to the engine crankshaft, which rotation is caused by a starting operation of a recoil starter, fuel supply means for supplying the fuel injection valve with fuel pressurized by a mechanical pump driven in an interlocked relation to the crankshaft, and control means for providing an "open" instruction to the fuel injection valve driving means according to a voltage appearing on a reset input terminal of a microcomputer for controlling the fuel injection valve until of the microcomputer commences normal operation after completion of a reset or initialization.

A feature of another embodiment of the present invention resides in the provision, in addition to the above power source means and fuel supply means, of means for causing the fuel injection valve to be opened immediately upon detection of the starting up of normal operation of the microcomputer controlling the fuel injection valve, and means for controlling the fuel injection valve such as to cause fuel injection during "open" valve intervals based on a predetermined fuel injection pattern at predetermined fuel injection timings after the microcomputer commences normal operation.

According to the present invention, in an initial stage of cranking an "open valve" instruction is output according to a voltage appearing on the microcomputer reset input line, independently of whether there is an input of a fuel injection timing detection signal. In consequence, fuel for starting is injected before the microcomputer commences normal operation, but at the timing of reaching of a predetermined value by the generator output voltage and also reaching of the lowest injection valve operation voltage by the power source voltage. Thus, a few ignition timings in the cranking period are not easily missed.

In the case when fuel for starting is injected from an instant right after the starting up of normal operation of the microcomputer, since the "open" valve interval can be controlled adequately, a few ignition timings in the cranking period are not easily missed, too. When the microcomputer has commence normal operation, the generator output voltage is high, and the ignition unit is able to generate sufficient energy for ignition. Thus, even if the start of the engine has failed, less non-combusted fuel is accumulated and stagnated.

DETAILED DESCRIPTION OF THE PREFERRED EMBODIMENT

Figure 5:
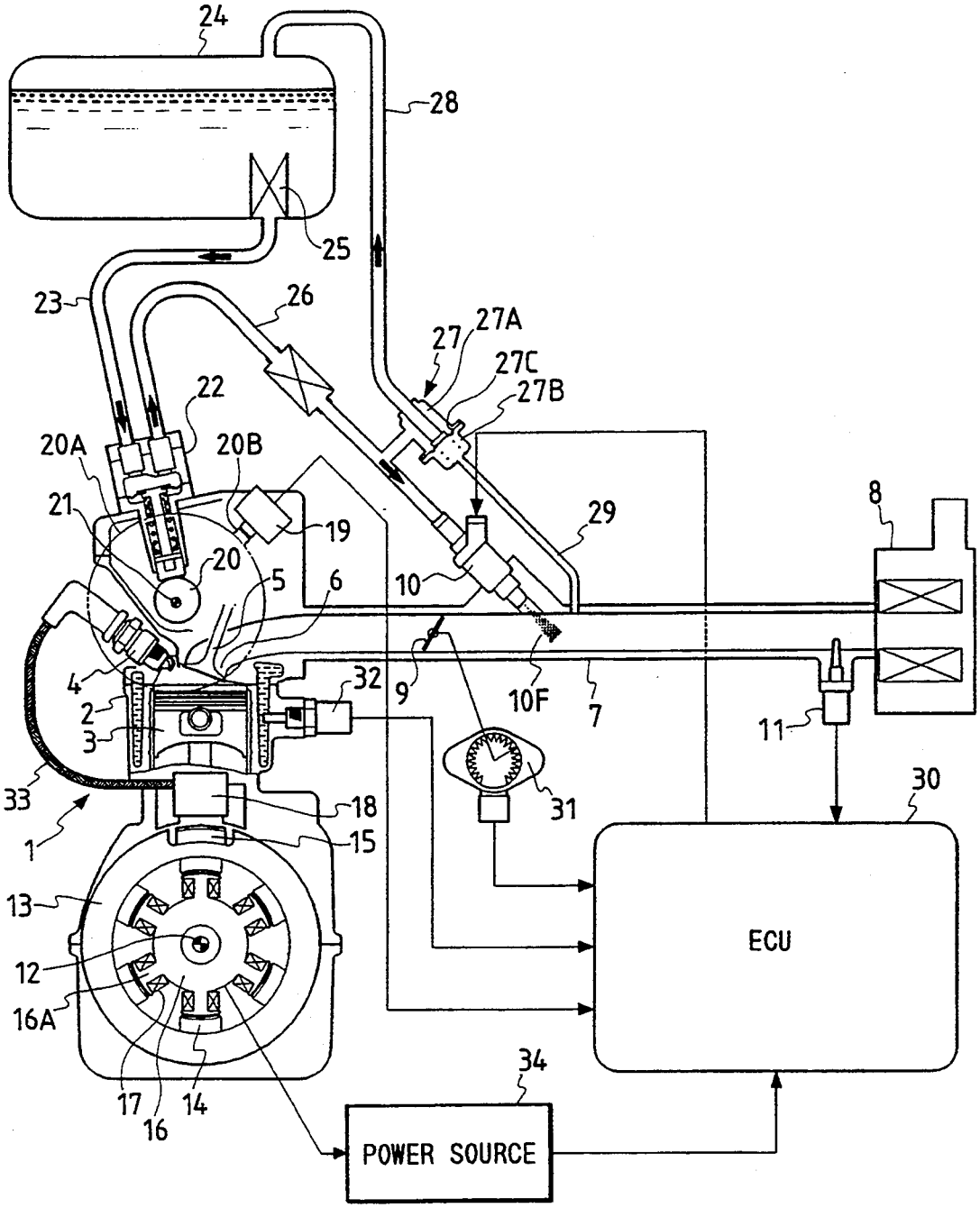
FIG. 5 is a schematic representation of a universal engine illustrating one embodiment of the present invention.

Now, the present invention will be described in detail with reference to the drawings. FIG. 5 is a view of an internal combustion engine and a control system incorporating the present invention. An engine 1 includes a cylinder 2 having a piston 3 and an ignition plug 4. An intake valve 5 is provided at an intake port 6 open to the top of the cylinder 2. The intake port 6 is communicated with atmosphere via an intake manifold 7 and an air cleaner 8. The intake manifold 7 is provided with a throttle valve 9 and also provided upstream of the same with a fuel injection valve 10 and a temperature sensor 11 for detecting the intake air temperature. Fuel 10F is injected from the fuel injection valve 10 into the intake manifold 7 upstream the throttle valve 7.

For manually rotating a crankshaft 12 at the time of the start, a recoil starter (not shown) is mounted on the outer end of a flywheel 13. The flywheel 13 is mounted on the crankshaft 12 of the engine 1. The inner and outer peripheries of the flywheel 13 are each provided with six first magnets 14 and a single second magnet 15. A starer core 16 has six projecting portions 16A, which face the respective first magnets 14, and on which are wound respective coils 17 constituting generator windings. The first magnets 14 and generator windings constitute an injection valve drive power source unit. The coils 17 are connected to a power source circuit 34 for rectifying and stabilizing the generated voltage. The power source circuit 34 supplies the stabilized power source voltage to an ECU 30.

An ignition unit 18 including an ignition coil (not shown) is provided such as to face the second magnet 15. The ignition unit 18 is connected via a lead wire 33 to the ignition plug 4. In this embodiment, the ignition unit 18 is desirably of self-triggering type.

Above the cylinder 2 are disposed a fuel pump 22 for pressurizing fuel supplied to the injection valve 10 and a cam 20 for driving the fuel pump 22. The earn 20 has a shaft 21 with a pulley 20A secured thereto. A timing belt (not shown) is passed around the pulley 20A and the crankshaft 12 such that the cam 20 is driven in synchronism to the crankshaft rotation. A third magnet 20B is provided on the outer periphery of the pulley 20A, and a TDC sensor 19 for detecting the TDC timing is provided such as to face the third magnet 20B.

The fuel pump 22 has its inlet connected via a duct 23 to a fuel tank 24 and its outlet connected via a duct 26 to the injection valve 10 and also to a pressure regulator 27. The end of the duct 23 opening to the fuel tank 24 is provided with a fuel filter 25. Fuel in the fuel tank 24 is thus supplied through the fuel filter 25 and duct 23 to the fuel pump 22, The pressure regulator 27 has a fuel chamber 27A and a negative pressure chamber 27B, these chambers being partitioned by a diaphragm 27C having a valve body. To the fuel chamber 27A are connected the duct 26 and a duct 28 communicating with the fuel tank 24. To the negative pressure chamber 27B is connected a duct 29 which communicates with the intake manifold 7 in the proximity of the injection port of the injection valve 10. Thus, fuel is partly fed back to the fuel tank 24 by the pressure regulator 27 according to the negative pressure in the neighborhood of the injection port of the injection valve 10, whereby the pressure of the fuel supplied to the injection valve 10 is regulated to be substantially constant.

The engine 1 is provided with a throttle valve opening sensor 31 for detecting the opening degree of the throttle valve 9 and also with an engine temperature sensor 32 for detecting the cooling water temperature of the cylinder 2. Detection signals from these sensors 31 and 32 are supplied to the ECU 30 together with the detection signals from the inspired air temperature sensor 11 and TDC sensor 19. The ECU 30 calculates the "open" timing and "open" time (duration) of the injection valve 10 and outputs an injection valve drive signal to open the injection valve 10, thus causing injection of fuel 10F into the intake manifold 7.

Now, the operation of the engine will be described. When the flywheel 13 secured to the crankshaft 12 is rotated by manually operating the recoil starter (not shown), the cam 20 is rotated to drive the fuel pump 22, thus pressurizing fuel. The rotation of the flywheel 13 also causes voltage generation on the generator coils 17 to supply power via the power source circuit 34 to the ECU 30, and concurrently causes an ignition plug drive voltage on the ignition coil in the ignition unit 18, whereby the voltage is applied to the ignition plug 4.

Since in the engine 1 the first magnets 14 and coils 17 which generate electric power for driving the injection valve and the second magnet 15 and ignition unit 18 which generate electric power for driving the ignition plug are provided independently, great source voltage swing or drop in the ignition unit due to every ignition operation does not substantially directly affect the source voltage for driving the injection valve. Thus, there is no mutual interference of the operations of ignition and of fuel injection with each other, and the injection valve 10 and ignition plug 4 can be operated efficiently even with comparatively low power energy based on the inertial rotational energy of the flywheel 13 in the course of cranking of the engine.

Figure 2:
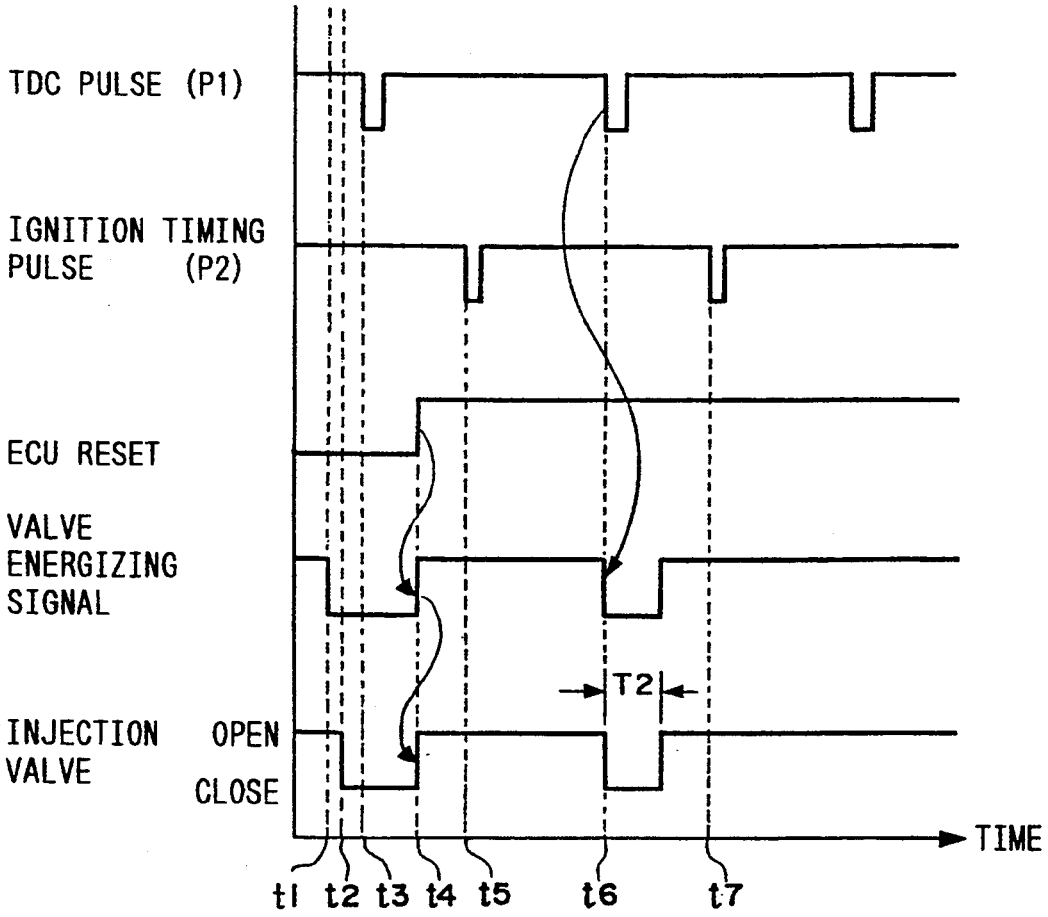
FIG. 2 is a timing chart illustrating an example of the starting operation according to the present invention.
Figure 6:
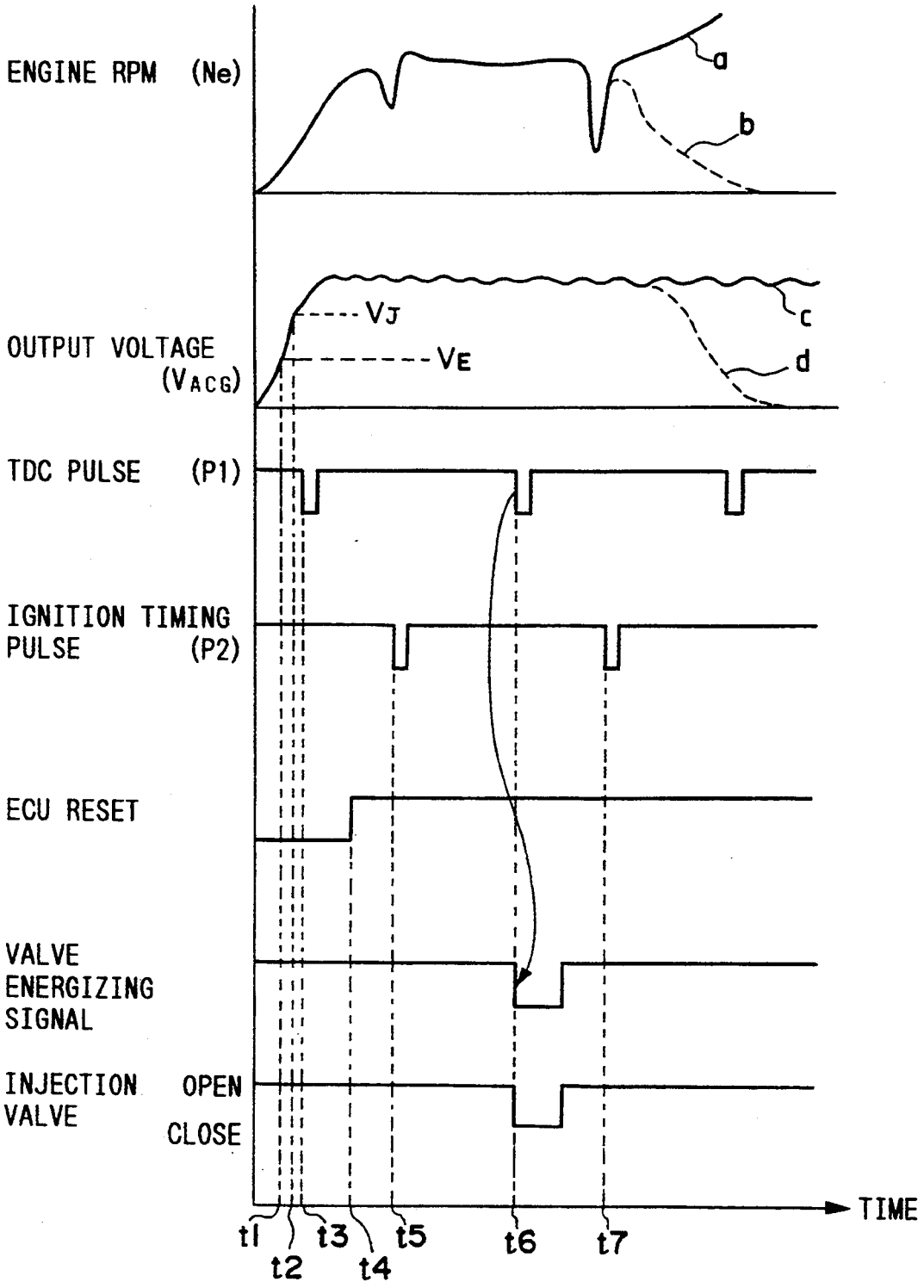
FIG. 6 PRIOR ART
FIG. 6 is a timing chart illustrating the operation of a prior art apparatus.

Now, fuel injection control in the present embodiment at the time of the starting up will be described with reference to the timing chart of FIG. 2. Referring to the Figure, reference symbols t1 to t7 designate the same timings from the commencement of cranking as those in FIG. 6.

Upon reaching of the permissible lowest operation voltage $V_E$ (FIG. 6) by the generator output voltage $V_{ACG}$ at the instant t1, the resetting operation of the ECU 30 which is of low-active or negative logic type commences, while at the same time the injection valve energizing signal is turned on. At this instant, the lowest operation voltage VJ of the injection valve 10 has not yet been reached by the generator output voltage $V_{ACG}$, and the injection valve 10 is not opened. Upon reaching of the lowest operation voltage $V_J$ of the injection valve 10 by the generator output voltage $V_{ACG}$ at the instant t2, a sufficient terminal voltage is applied across the coil of the injection valve 10 to open the valve 10 so as to cause fuel injection.

When the ECU 30 commences normal operation (at the instant t4) subsequent to completion of the resetting or initialization thereof, the injection valve energizing signal is turned off to remove the terminal voltage across the coil of the injection valve 10. As a result, the fuel injection is discontinued.

While the present embodiment has been described in the case where the lowest operation voltage of the injection valve is higher than that of the ECU, the two voltages may be in the converse relation as well. In the latter case, the injection valve is opened to inject fuel simultaneously with the commencement of the resetting operation. In either case, additional fuel injection for the start is commenced at the instant when each of the lowest operation voltages of the ECU and fuel injection valve is surpassed by the output voltage of the power source 34.

After commencement of the ECU 30 operation subsequent to the completion of the resetting, the injection valve 10 is opened to inject fuel for a fuel injection time determined according to a predetermined fuel injection pattern at predetermined timings, i.e., whenever the TDC pulse P1 is detected. At the first instant t6 after commencement of normal operation of the ECU 30 the injection valve energizing signal is turned on in response to the TDC pulse P1, whereby fuel is injected for a predetermined period T2 of time.

The fuel injection time T2 is read out of a map preliminarily stored in a memory as functions of the value of the throttle opening angle sensor 31 and the engine rpm. Further, if necessary, correction coefficients based on the engine temperature and engine acceleration are predetermined and utilized.

Figure 1:
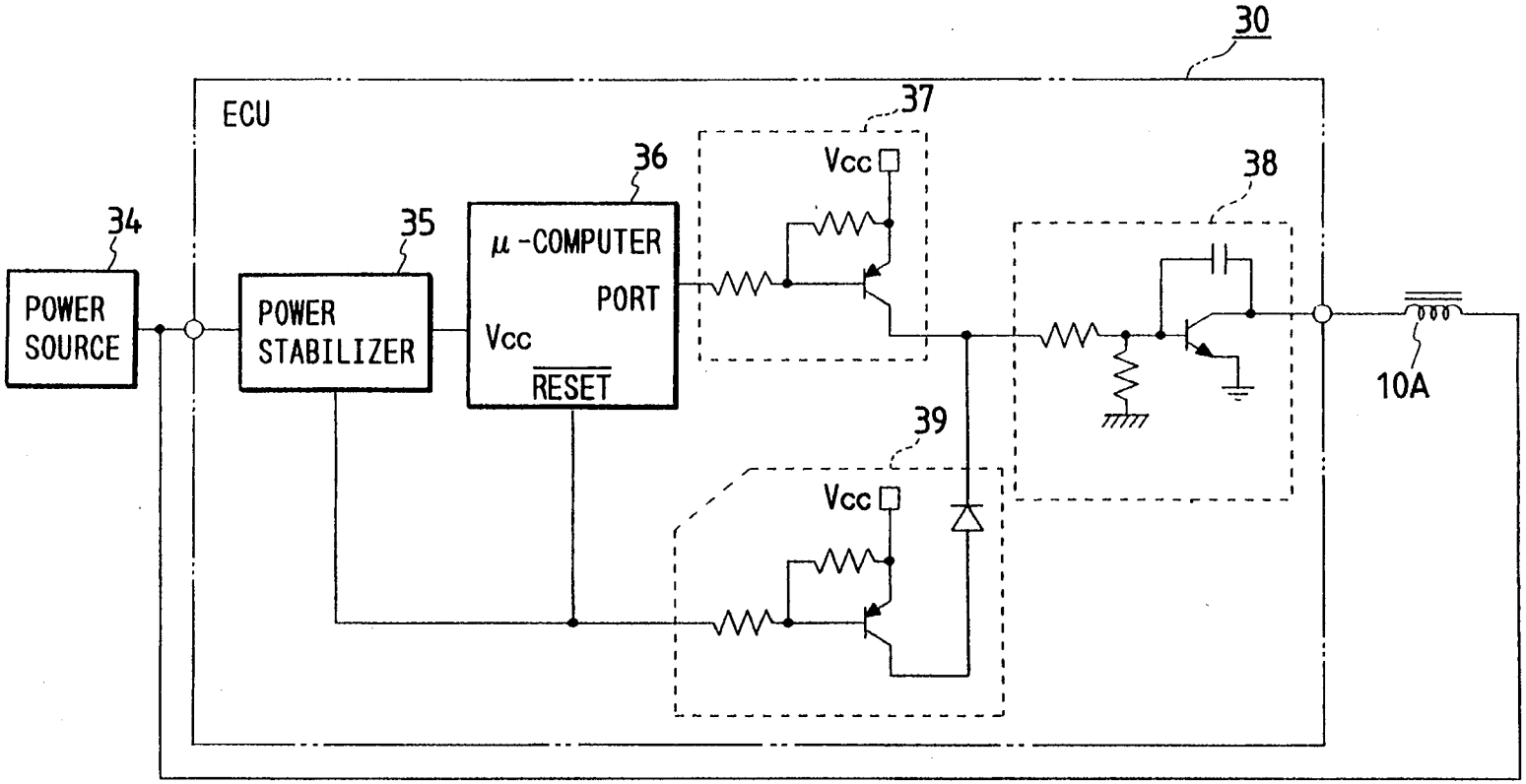
FIG. 1 is a circuit diagram showing a main hardware structure of an ECU related to the present invention.

The main hardware construction of the ECU 30 for performing the operation shown in FIG. 2 will be described with reference to the circuit diagram of FIG. 1. The ECU 30 includes a power source voltage stabilizer 35, which supplies the voltage from the power source circuit 34 after stabilization for microcomputer control to a Vcc terminal of the microcomputer 36. The power source voltage stabilizer 35 also produces a reset signal for resetting the microcomputer 36, the reset signal being supplied to a reset terminal of the microcomputer 36, which has "L active" structures in this embodiment.

The microcomputer 36 has an output port coupled to the input of a pre-driver 37, the output of which is coupled to the input of a driver 38. The output of the driver 38 is coupled in turn to one end of the drive coil 10A of the injection valve, and the other end of the drive coil is connected to the power source circuit 34. The power source voltage stabilizer 35 has its reset signal line coupled to the input of the start pre-driver 39, the output of which is coupled to the input of the driver 38.

In normal operation after completion of the resetting of the microcomputer 36, the pre-driver 37 is energized by the injection valve energizing signal output from the port of the microcomputer 36. As a result, the driver 38 is energized to cause current supply from the power source circuit 34 to the drive coil 10A, thus opening the injection valve 10.

On the other hand, in the engine start operation, no control signal is output from the port of the microcomputer 36 during an initialization period from the commencement until the completion of the resetting of the microcomputer 36. Until the completion of the resetting operation, the start pre-driver 39 is energized by the reset signal in place of the control signal output, and its output signal energizes the driver 38. While the injection valve 10 is not opened before reaching of the rated lowest voltage by the generator output voltage $V_{ACG}$ right after the commencement of the resetting operation, it is opened to inject fuel upon reaching of the lowest operation voltage $V_J$ of the injection valve 10 by the generator output voltage $V_{ACD}$ (at the instant t2 in FIG. 2). When the resetting operation is completed and the reset, signal is inverted to high (H) at the instant t4, the start pre-driver 39 is rendered inoperative, and subsequently fuel is injected according to the control output from the port of the microcomputer 36.

Now, fuel injection control in a second embodiment of the present invention will be described with reference to the timing chart of FIG. 3 in which the reference symbols t1 to t7 designate the same timings from the commencement of cranking as in FIG. 2.

The ECU 30 commences the resetting operation at instant t1, and as soon as it starts normal operation following completion of the resetting at the instant t4, the fuel injection valve energizing signal is turned on, and in response to the energizing signal the injection valve 10 is energized to inject fuel. This fuel injection for the first time is continued for time period T1. The fuel injection then is discontinued once, and then the energizing signal is turned on again in response to the first TDC pulse P1 at the instant t6 right after the starting up of the ECU 30 for injecting fuel for time period T2 read out from the map memory (FIG. 4).

If the ignition is successful at the ignition instant t5 or t7 with these two fuel injections, the engine starts up, and subsequently the injection valve 10 is opened to inject fuel according to signals detected by the individual sensors such as the throttle valve opening angle sensor 31 and engine temperature sensor 32, at predetermined timings, i.e., whenever the TDC pulse P1 is detected, for periods of time decided by data accommodated in the map memory.

Figure 4:
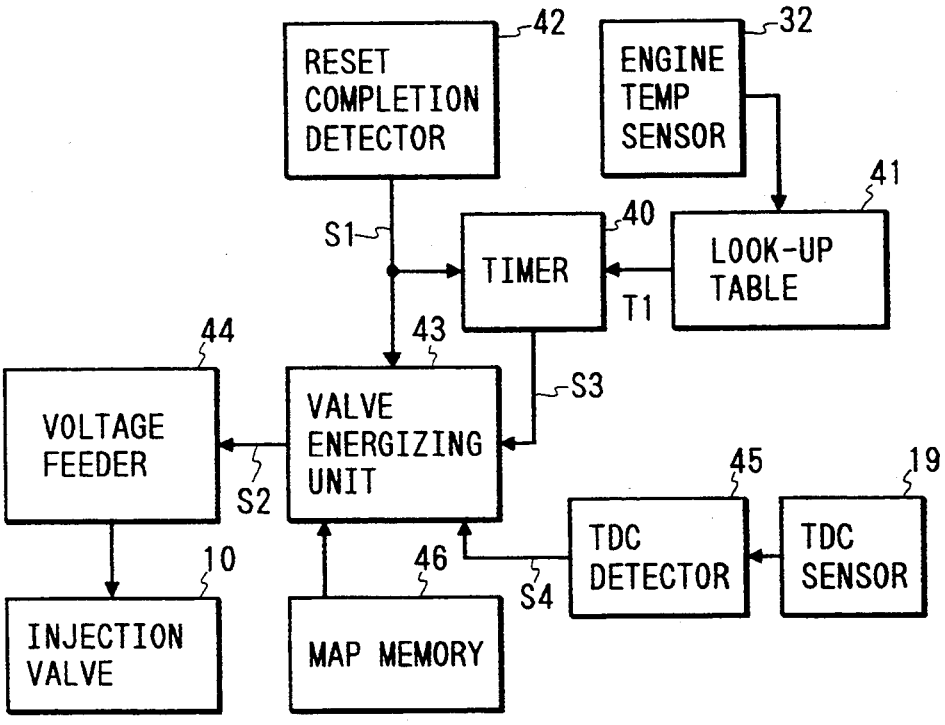
FIG. 4 is a functional block diagram of the ECU related to the present invention.

The setting of the fuel injection time period T1 is done by time setting in a timer (FIG. 4). The time setting is determined. for instance, as a function of the temperature of the engine or cooling water in the cylinder 2 as detected by the engine temperature sensor 32. More specifically, when the cooling water temperature becomes higher, a shorter time is set to provide less amount of fuel for injection. When the cooling water temperature becomes lower, on the other hand, a longer time is set to provide more amount of injection fuel. The fuel injection time period T1 may be set adequately between the completion of the resetting of the ECU 30 at the instant t4 and the instant t6. It may be set such that it is continuous to the fuel injection time period T2 after the instant t6 of detection of the TDC pulse P1 for the first time after the starting up of the ECU 30.

Figure 3:
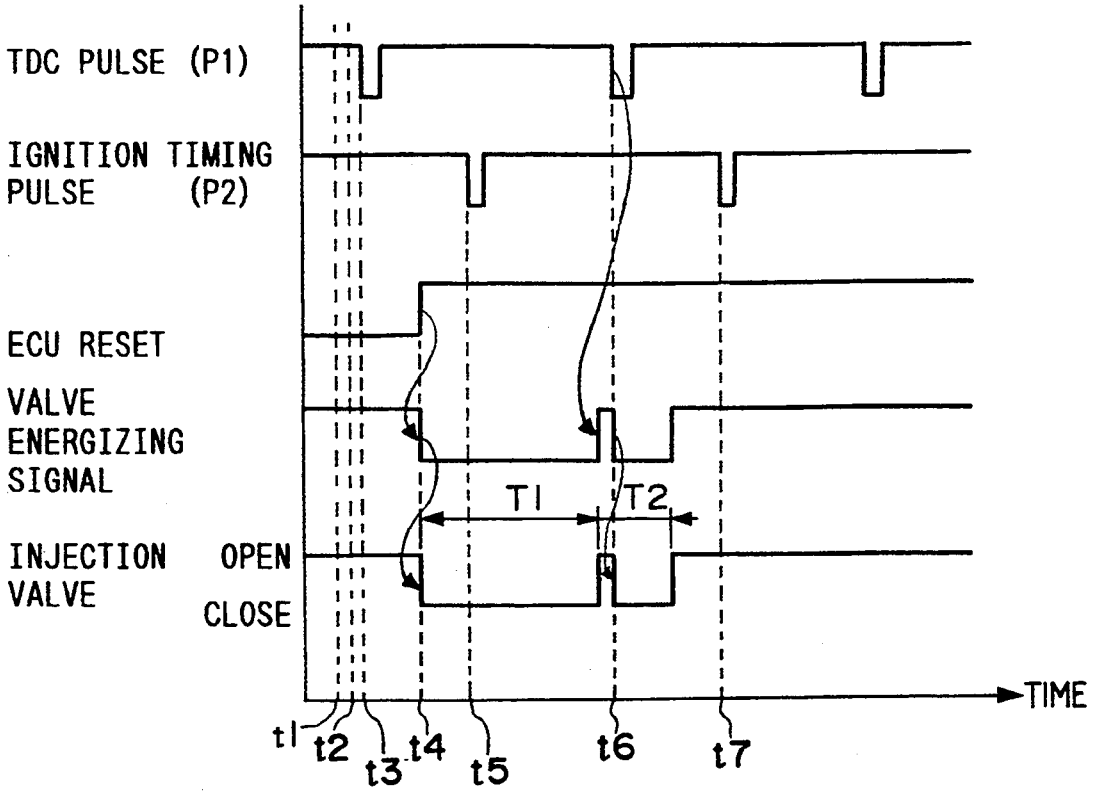
FIG. 3 is a timing chart illustrating another example of the starting operation according to the present invention.

The operation illustrated in FIG. 3 is carried out as software processing or the microcomputer 36 after the commencement of its normal operation at the instant t4. The functions of the ECU 30 for executing the operation shown in FIG. 8 will now be described with reference to the functional block diagram of FIG. 4. Fuel injection time period T1 which is read out from a look-up table 41 according to the engine temperature, i.e., the temperature of cooling water in the cylinder 2, as detected by the temperature sensor 32, is set in the timer 40.

When a reset operation completion detector 42 detects the completion of the resetting operation of the ECU 30, it outputs a detection signal S1 to a fuel injection valve energizing unit 43. In response to the detection signal S1, the fuel injection valve energizing unit 43 outputs a start signal S2 to a voltage feeder 44. In this way, a predetermined terminal voltage is supplied from the voltage feeder 44 to the coil of the injection valve 10 to inject fuel. The signal S1 is also supplied to the timer 40 which is thus started by the signal S1 and outputs a time-up signal S3 after the lapse of a preset time interval (T1). Under control of the time-up signal S3, the fuel injection valve energizing unit 43 discontinues the output of the start signal S2 to close the injection valve 10.

With the input of a TDC detection signal S4 from a TDC pulse detection unit 45, the fuel injection valve energizing unit 43 outputs the start signal S2 according to fuel injection time data read out of the map memory 46. The fuel injection time data has a value which is determined as a function of the throttle valve opening angle, engine temperature, intake air amount, etc., and it is preliminarily stored in the map memory 46. After the starting up of the microcomputer 36, fuel is injected at predetermined injection timings according to the fuel injection time data noted above.

The timer 40 may be reset when the generator output voltage has lowered below a predetermined level due to an engine start failure and be preset when the generator output voltage is increased again beyond the predetermined level, a time which is read out of the table 41 corresponding to the engine temperature at that instant. Desirably, the value prestored in the table 41 is variable according to the number of repeated cranking operations until the engine rpm exceeds a predetermined rpm after success of the engine start, the prestored value being reduced with increase in the number of repeated cranking operations. With this arrangement, even in the case of overlapped occurrence of start failures it is possible to suppress the amount of unburned fuel-air mixture in the cylinder.

Figure 7:
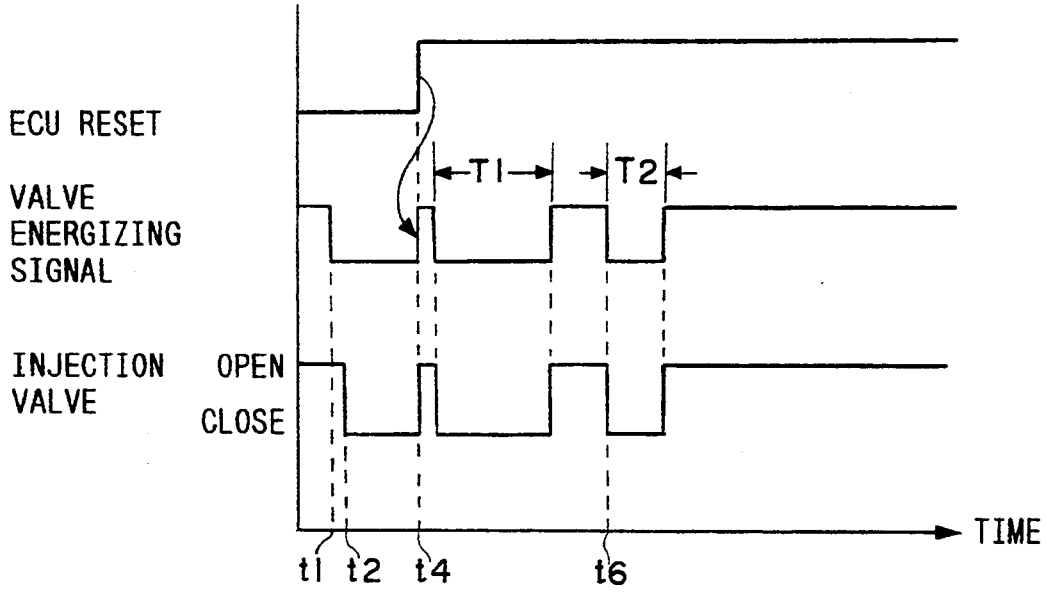
FIG. 7 is a timing chart illustrating a further example of the starting operation according to the present invention.

In the above embodiment fuel for the start is injected for the period from the instant when each of the lowest operation voltages of the ECU and fuel injection valve is surpassed by the output voltage of the power source 34 until the instant when the reset signal is turned off or for a predetermined period of time after completion of the resetting of the ECU. However, when this fuel injection is insufficient, it is possible to execute both of those operations of fuel injection. In other words, it is possible that as soon as the first start fuel injection is discontinued by the means shown in FIG. 1 in response to the completion of the resetting operation of the ECU (at t4), injection start signal S2 in response to the completion of the resetting operation is output by the system shown in FIG. 4, while at the same time a timer is started to continually output the injection valve energizing signal until the time-up of the timer. Such a control operation is illustrated in the timing chart of FIG. 7. It will be readily understood from the above explanation that the operation above mentioned can be executed with the apparatus shown in FIGS. 1 and 4.

In this embodiment, fuel for the start is injected for a period of time from the commencement of resetting the ECU 30 until the completion of resetting of the microcomputer so that it is ready to execute regular fuel injection control according to the TDC pulse.

The invention is particularly effectively applicable to single cylinder engines, in which there are less chances of ignition in one cranking operation, but it is also very effective for multi-cylinder engines in view of improving the starting properties.

According to the invention, it is possible to inject the fuel for start regardless of the fuel injection timing based on the TDC sensor input, but as soon as the starting up of the generator output voltage and/or starting up or completion of resetting of the microcomputer is detected and to inject fuel at the regular timing according to the sensor input, if the fuel injection timing based on the sensor input is obtained subsequently. Thus, it is possible to execute effective fuel injection for a successful engine start without missing a few ignition chances. In addition, since the fuel is injected when the generator output voltage has increased enough, i.e., while the conditions for the ignition are becoming set up, subsequent to the rising of the microcomputer, in the case of executing the cranking afresh due to a start failure less unburned gas is retained, and thus it is possible to suppress generation of unburned exhaust gas at the time of engine start.

Further, according to the present invention the starting performance improvement above mentioned can be realized without complicating the structure of the fuel supply system. Thus, the invention is applicable to small displacement engines or like universal engines adopting the recoil starter system without spoiling the features of the small size, light weight and simple structure thereof.

What is claimed is:

1. An electronic fuel injection system without a battery for an internal combustion engine comprising a recoil starter, a fuel injection valve for supplying fuel to an intake-manifold of the engine, a mechanical fuel pump driven in an interlocked relation to the rotation of an engine crankshaft with a flywheel driven by a starting operation of said recoil starter, means for supplying fuel pressurized by said mechanical fuel pump to said fuel injection valve, fuel injection valve drive means for on-off controlling said fuel injection valve, and a microcomputer means for supplying, after a resetting thereof, a fuel injection valve control signal to said fuel injection valve drive means according to a predetermined fuel injection pattern corresponding to engine operating conditions, said electronic fuel injection system further comprising:

power source means for supplying a voltage generated with flywheel rotation by cranking of the recoil starter, as operating power to said fuel injection valve drive means and to said microcomputer;

means for detecting completion of said resetting of said microcomputer means; and means operative, prior to normal fuel injection according to said predetermined fuel injection pattern, or opening said fuel injection valve for a predetermined time interval in response to a detection signal generated in response to said detection of completion of resetting of said microcomputer means.

2. The electronic fuel injection system according to claim 1 wherein said microcomputer means is of negative logic type or low active type.

3. The electronic fuel injection system according to claim 1 wherein said predetermined time interval is preset in a timer in advance.

4. The electronic fuel injection system according to claim 1 wherein said predetermined time interval is long enough to keep said fuel injection valve open until a first fuel injection according to the predetermined fuel injection pattern.

5. The electronic fuel injection system according to claim 3, wherein said predetermined time interval is preliminarily determined as a function of an engine temperature.

6. The electronic fuel injection system according to claim 3, wherein said predetermined time interval is preliminarily determined as a function of a temperature of an engine cooling water.

7. An electronic fuel injection system without a battery for an internal combustion engine comprising a recoil starter, a fuel injection valve for supplying fuel to an intake-manifold of the engine, a mechanical fuel pump driven in an interlocked relation to the rotation of an engine crankshaft with a flywheel driven by a starting operation of said recoil starter, means for supplying fuel pressurized by said mechanical fuel pump to said fuel injection valve, fuel injection valve drive means for on-off controlling said fuel injection valve and a microcomputer means for supplying, after initialization thereof, a fuel injection valve control signal to said fuel injection valve drive means according to a predetermined fuel injection pattern corresponding to engine operating conditions, said electronic fuel injection system further comprising:

power source means for supplying a voltage generated with flywheel rotation by cranking of the recoil starter, as operating power to said fuel injection valve drive means and to said microcomputer; and fuel injection valve control means for providing an "open" instruction to the fuel injection valve driving means according to a voltage appearing on a reset input terminal of the microcomputer for controlling the fuel injection valve during the initialization of the microcomputer, and for causing the injection valve to inject the fuel when the power source voltage reaches a lowest injection valve operation voltage.

8. The electronic fuel injection system according to claim 7 further comprising means for generating a signal upon completion of the resetting of said microcomputer means, and means for opening said fuel injection valve for a predetermined time interval in response to said signal.

9. The electronic fuel injection system according to claim 8 wherein said microcomputer means is of negative logic type or low active type.

10. The electronic fuel injection system according to claim 8 wherein said predetermined time interval is preset in a timer in advance.

11. The electronic fuel injection system according to claim 8 wherein said predetermined time interval is long enough to keep said fuel injection valve open until a first fuel injection according to the predetermined fuel injection pattern.

12. The electronic fuel injection system according to claim 10 wherein said predetermined time interval is preliminarily determined as a function of an engine temperature.

13. The electronic fuel injection system according to claim 10 wherein said predetermined time interval is preliminarily determined as a function of a temperature of an engine cooling water.

14. The electronic fuel injection system according to claim 10 wherein said predetermined time interval is preliminarily determined as a function of the number of repeated cranking operations before the engine rpm reaches a predetermined value.

15. An electronic fuel injection system without a battery for an internal combustion engine comprising a recoil starter, a fuel injection valve for supplying fuel to an intake-manifold of the engine, a mechanical fuel pump driven in an interlocked relation to the rotation of an engine crankshaft with a flywheel driven by a starting operation of said recoil starter, means for supplying fuel pressurized by said mechanical fuel pump to said fuel injection valve, fuel injection valve drive means for on-off controlling said fuel injection valve, and a microcomputer means for supplying, after a resetting thereof, a fuel injection valve control signal to said fuel injection valve drive means according to a predetermined fuel injection pattern corresponding to engine operating conditions, said electronic fuel injection system further comprising:

power source means for supplying a voltage generated with flywheel rotation by cranking of the recoil starter, as operating power to said fuel injection valve drive means and to said microcomputer;

detector means for detecting completion of said resetting of said microcomputer means; and means for opening said fuel injection valve for a predetermined time interval in response to a signal from said detector means generated upon completion of said resetting of said microcomputer means, said predetermined time interval being preset in a timer and being preliminarily determined as a function of the number of repeated cranking operations before the engine rpm reaches a predetermined value.

* * * * *